US007107647B2

(12) United States Patent
Park

(10) Patent No.: US 7,107,647 B2
(45) Date of Patent: Sep. 19, 2006

(54) APPARATUS OF DRIVING AGITATOR OF UPRIGHT VACUUM CLEANER

(75) Inventor: Sang Jun Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 279 days.

(21) Appl. No.: 10/608,099

(22) Filed: Jun. 30, 2003

(65) Prior Publication Data

US 2004/0200031 A1 Oct. 14, 2004

(30) Foreign Application Priority Data

Apr. 8, 2003 (KR) ..... 10-2003-0021962

(51) Int. Cl.
*A47L 5/28* (2006.01)
*A47L 9/04* (2006.01)

(52) U.S. Cl. ..... 15/390

(58) Field of Classification Search ..... 15/332, 15/333, 389, 390

See application file for complete search history.

(56) References Cited

U.S. PATENT DOCUMENTS 1,978,526 A * 10/1934 Eppler, Jr. ..... 474/89
2,094,138 A * 9/1937 White ..... 474/119
2,250,282 A * 7/1941 Swann ..... 15/332
2,601,698 A * 7/1952 Humphrey ..... 15/390
6,067,689 A * 5/2000 Roney et al. ..... 15/390
6,098,243 A * 8/2000 Kim ..... 15/390
6,158,084 A * 12/2000 Weber et al. ..... 15/390
6,209,168 B1 * 4/2001 Brickner et al. ..... 15/332
6,374,453 B1 * 4/2002 Kim ..... 15/328

FOREIGN PATENT DOCUMENTS

JP 2002-330907 * 11/2002

* cited by examiner

*Primary Examiner*—Terrence R. Till
(74) *Attorney, Agent, or Firm*—McKenna Long & Aldridge LLP

(57) ABSTRACT

The present invention relates to an apparatus of driving an agitator of an upright vacuum cleaner. It includes a fixing panel and a rotation guide which are positioned at an outer side of the driving shaft roller and guided to move coaxially with the driving shaft roller so as to conveniently switch a power transmitted to an agitator by a user's foot; a support sphere and a roller support part which are formed in a direction of an axis parallel with the driving shaft roller on an outer circumference of the rotation guide; an idle roller which is inserted into the roller support part; a manipulating means connected with the support sphere, for controlling the rotation guide so that the elastic member is selectively wound around the driving shaft roller or the idle roller; and a stop means for maintaining a position of the rotational driving part stably.

24 Claims, 9 Drawing Sheets

APPARATUS OF DRIVING AGITATOR OF UPRIGHT VACUUM CLEANER

This application claims benefit of Korean Application No. 2003-21962, filed on Apr. 8, 2003, which is hereby incorporated by reference as if fully set forth herein.

BACKGROUND OF THE INVENTION

1. Field of the Invention

The present invention relates to an apparatus of driving an agitator (for example, a rotating brush) of an upright vacuum cleaner, and more particularly, to an apparatus of driving an agitator of an upright vacuum cleaner, for intermittently supplying a power to the agitator used in removing dust from a floor such as carpet, etc. in using the upright vacuum cleaner.

More particularly, when the agitator rotates with contacting a bare floor, the roughness increases on the smooth surface of the bare floor and the gloss and beauty on the surface degenerates. Thus, required is an apparatus that rotates the agitator when cleaning a floor such as a carpet that has a lot of dust but does not rotate the agitator when cleaning a smooth floor such as a bare floor according to user's will. The present invention is directed to an apparatus to intermittently supply power to the agitator.

2. Description of the Related Art

Generally, an upright vacuum cleaner is a kind of vacuum cleaners, and its use is being increased since it can be used conveniently even though the body of the vacuum cleaner is not provided separately. Especially, the body of the vacuum cleaner is provided with a dust pocket, a motor, a suction fan, etc. as separate elements. The separated elements of the cleaner cause an inconvenience in its use.

To overcome this problem, the upright vacuum cleaner sucks dust and muck on objects using a suction force generated by the motor and the fan integrated in the body. Especially, the upright vacuum cleaner has a portable suction inlet and is used in cleaning an object of a large area such as a floor and a carpet.

FIG. 1 is a perspective view of a general upright vacuum cleaner.

Referring to FIG. 1, an upright vacuum cleaner includes a body 10 with a handling part at its upper portion, a suction unit 11 installed at a lower portion of the body 10, for sucking air and muck, moving wheels 12 installed at a lower portion of the body so as to move the body 10, a connection pipe 13 for connecting the suction unit 11 with a unit such as a dust pocket, for transferring the air sucked from the suction unit 11 to the dust pocket, an air vent grille 14 installed at a side of the body 10, for exhausting the sucked air, and a power line 15 for supplying a power to the cleaner.

Also, the upright vacuum cleaner further includes an agitator 16 which is installed at a front lower portion of the suction unit 11 and in which a brush is wound spirally around an outer circumference thereof so that dust is removed from the floor such as a carpet and sucked, a belt 17 one end of which is wound around the agitator 16 so as to transmit a driving force to the agitator 16, and a driving shaft 18 the other end of which is wound around an outer circumference of the driving shaft 18 so as to transmit a driving force to the agitator 16.

Especially, the driving shaft 18 is usually driven by another motor separated from the main motor for driving the suction fan of the body 10 of the cleaner and generating the suction force.

According to this structure, the motor for driving the agitator 16 is provided separated from the main motor for driving the suction fan, so that the production cost for manufacturing the upright vacuum cleaner increases.

Also, a special construction in which two motors are applied is required, which makes the vacuum cleaner complicated and large in size.

SUMMARY OF THE INVENTION

Accordingly, the present invention is directed to an apparatus for driving an agitator of an upright vacuum cleaner that substantially obviates one or more problems due to limitations and disadvantages of the related art.

An object of the present invention is to provide an apparatus for driving an agitator of an upright vacuum cleaner, in which a main motor for generating an air suction force is used to drive the agitator, thereby lowering the manufacturing cost.

Another object of the present invention is to provide an apparatus of driving an agitator of an upright vacuum cleaner whose size is reduced so that a user can carry conveniently.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus of driving an agitator of an upright vacuum cleaner includes: a motor for driving a suction fan of the vacuum cleaner; a driving shaft roller installed at an end of the motor, around which a power transmission member is wound intermittently; a bushing mounted on an outer circumference of the driving shaft roller; a fixing panel fixed to the vacuum cleaner; a rotational driving part which the bushing is inserted at a center thereof, the rotational driving part rotating around the driving shaft roller; a selection lever rotating around a lever hole hinge-coupled to the fixing panel by an external force caused by a user; a selection link one end of which is hinge-coupled to the body of the selection lever; a support or link connecting part formed extending in a direction of an axis parallel with the driving shaft roller on an outer circumference of the rotational driving part and coupled with the other end of the selection link; a roller support part formed extending in an opposite direction to the support or link connecting part; an idle roller which is inserted into an outer circumference of the roller support part and around which the power transmission member is wound intermittently due to rotation of the entire rotational driving part so that power is controlled to be transmitted; and a stop means for maintaining a position which is determined by a self-rotation of the rotational driving part.

In another aspect of the present invention, an apparatus of driving an agitator of an upright vacuum cleaner includes: a driving shaft roller installed at an end of a motor of the vacuum cleaner, around which a power transmission member is wound intermittently; a bushing installed on an outer circumference of the driving shaft roller coaxially with a driving shaft; a fixing panel inserted onto the bushing; a selection lever rotating about a lever hole hinge-coupled to the fixing panel by an external force caused by a user; a selection link whose one end is hinge-coupled to the body of the selection lever; a rotational driving part including a rotation guide which is shaped in a circular skirt and into which a bushing is inserted and rotated, a support or link connecting part formed extending in a direction of an axis parallel with the driving shaft roller on an outer circumference of the rotation guide and coupled with one end of the selection link, and a roller support part formed extending in an opposite direction to the support or link connecting part; an idle roller which is inserted onto an outer circumference of the roller support part and around which the power transmission member is wound intermittently due to a self-rotation of the entire rotational driving part such that a power transmission is controlled; and a stop means for maintaining a position which is determined by the self-rotation of the rotational driving part.

In another aspect of the present invention, an apparatus of driving an agitator of an upright vacuum cleaner, includes: a driving shaft roller which is connected to a motor for driving a suction fan of the vacuum cleaner and around which an elastic member is selectively wound; a bushing installed on an outer circumference of the driving shaft roller coaxially with a driving shaft; a fixing panel and a rotational driving part which are inserted into the bushing and fixed; a support or link connecting part and a roller support part which are formed in a direction of an axis parallel with the driving shaft roller on an outer circumference of the rotational driving part; a manipulating means connected with the support or link connecting part, for manipulating the rotational driving part; an idle roller which is inserted into the roller support part and around which an elastic member is wound; and a stop means for maintaining a position of the rotational driving part stably.

In another aspect of the present invention, an apparatus of driving an agitator of an upright vacuum cleaner includes: a driving shaft roller extending from the vacuum cleaner; a fixing panel and a rotation guide which are positioned outside the driving shaft roller and guided coaxially with the driving shaft roller; a support or link connecting part and a roller support part which are formed in a direction of an axis parallel with the driving shaft roller on an outer circumference of the rotation guide; an idle roller which is inserted into the roller support part; a manipulating means connected with the support or link connecting part, for manipulating the rotation guide so that the elastic member is selectively wound around the driving shaft roller or the idle roller; and a stop means for maintaining a position of the rotational driving part stably. guide; an idle roller which is inserted into the roller support part; a manipulating means connected with the support sphere, for manipulating the rotation guide so that the elastic member is selectively wound around the driving shaft roller or the idle It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The present invention is not limited to the embodiments. It will be apparent to those skilled in the art that various modifications and variations can be made in the present invention.

Figure 1:
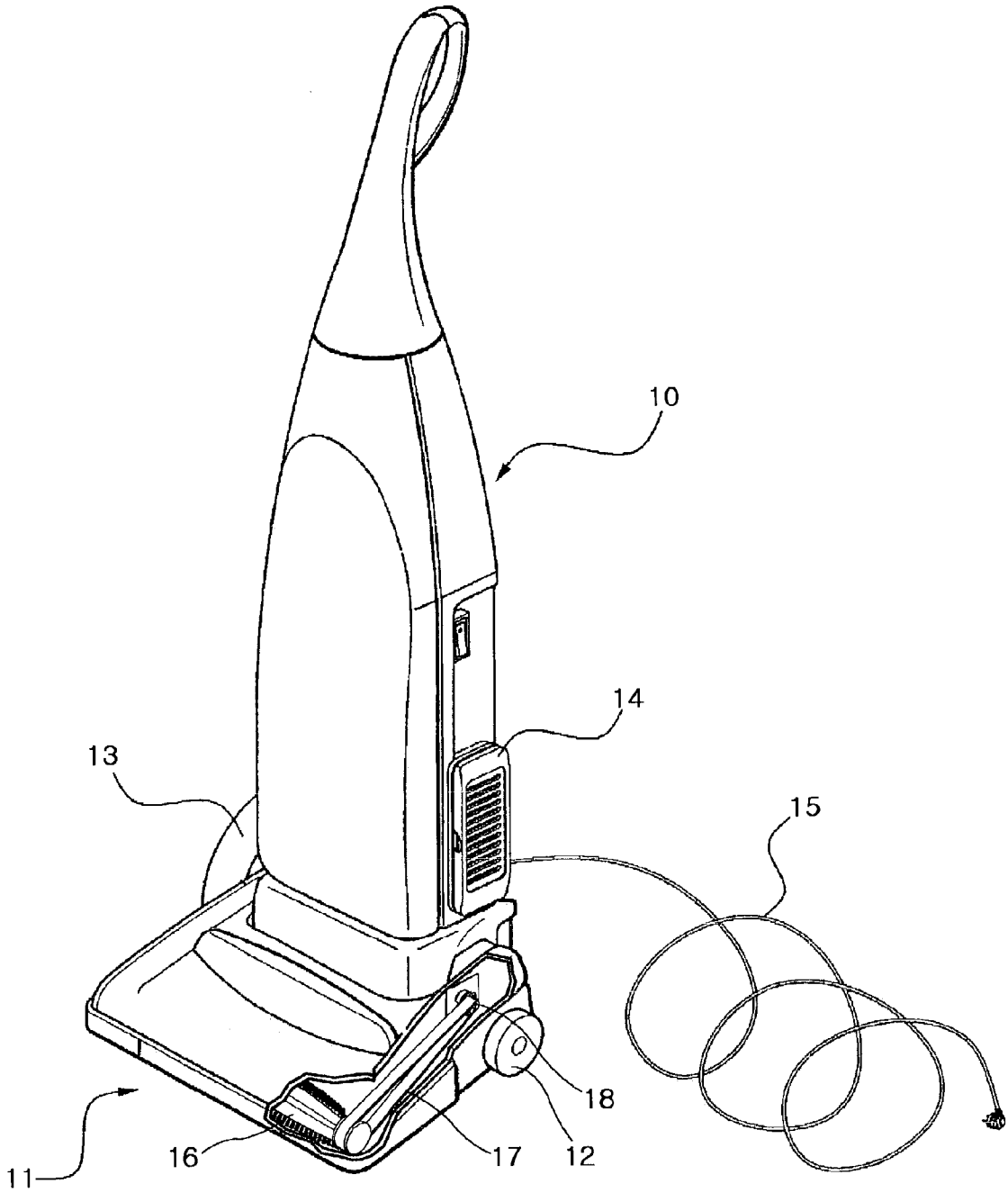
Fig. 1 (Related art)
FIG. 1 is a perspective view of a conventional upright vacuum cleaner.
Figure 2:
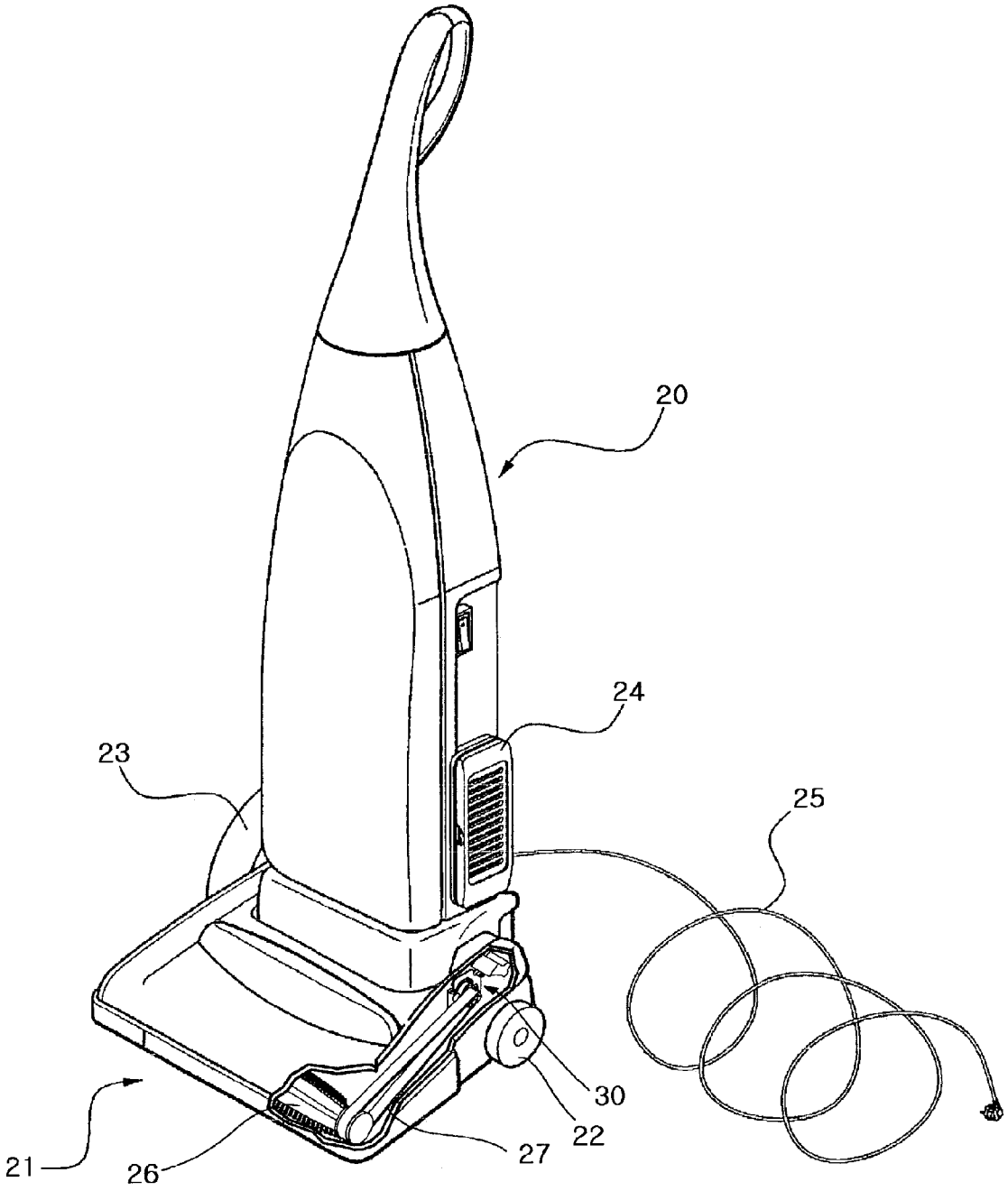
FIG. 2 is a perspective view of a upright vacuum cleaner for illustrating the spirit of the present invention.

FIG. 2 is a perspective view of an upright vacuum cleaner for illustrating the spirit of the present invention.

In an upright vacuum cleaner to which an agitator driving apparatus according to the present invention is applied, a body 20, an inlet 21, a moving wheel 22, a connection pipe 23, an air vent grille 24, a power line 25, an agitator 26 and a belt 27 are the same as those of the vacuum cleaner provided in the related art. However, these elements are not restricted only to the whole construction of the upright vacuum cleaner to which the apparatus of driving an agitator according to the spirits of the invention is applied.

In the present invention, one end of the belt 27 is wound around an outer circumference of one end of the agitator 26. The other end of the belt 27 can be selectively wound around any one of two rollers depending on a transmission state of power.

One of the two rollers is a driving shaft roller (see 29 in FIG. 3) connected to the driving shaft of the motor and the other is an idle roller (see 380 in FIG. 3) which is not connected to any motor. Especially, the motor is a main motor used to drive a suction fan in the electric cleaner. In other words, the motor for driving the suction fan and the motor for driving the agitator in the vacuum cleaner are an identical motor.

In the meanwhile, in order to transmit the power of the belt 27 to the two rollers selectively, an agitator driving apparatus 30 is further installed. Also, a bushing (see 28 in FIG. 3) is further formed on an outer circumference of the driving shaft roller 29 such that the agitator driving apparatus 30 is guided precisely.

Figure 3:
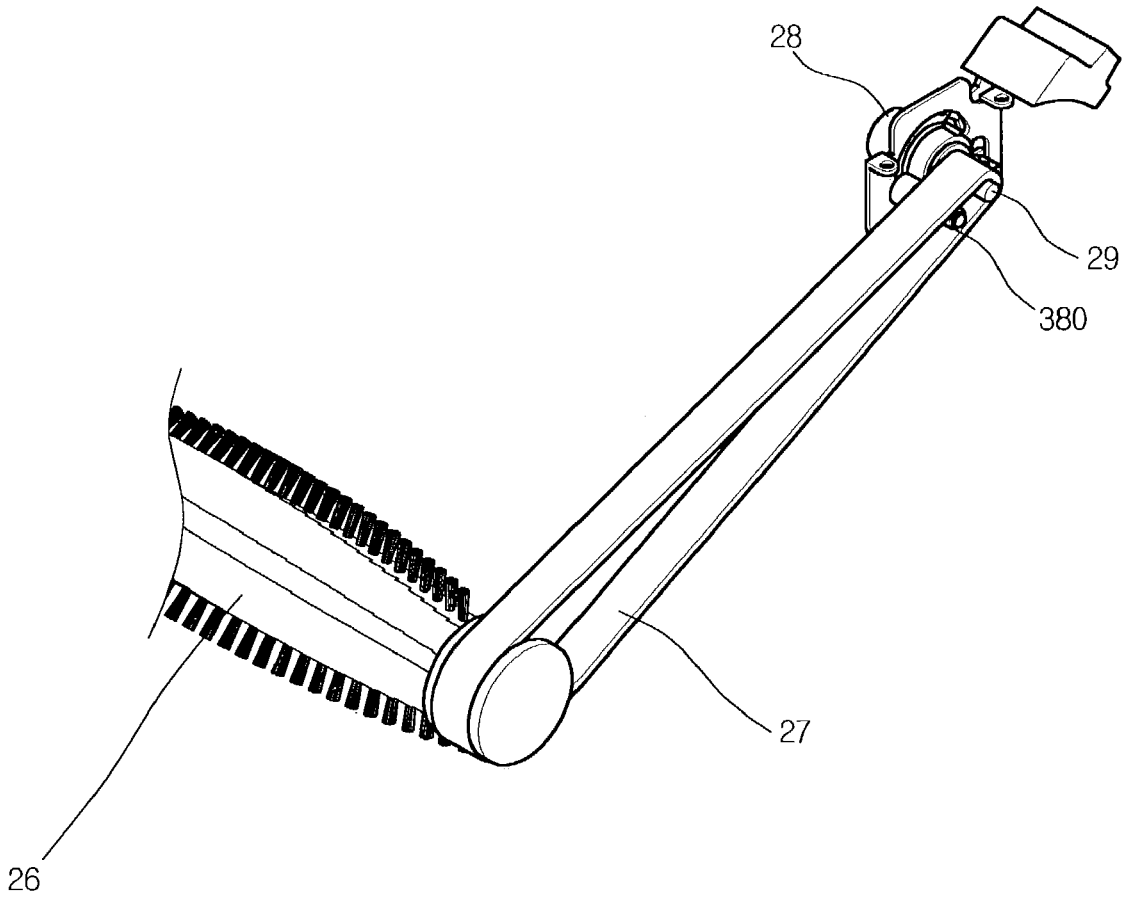
FIG. 3 is a magnified perspective view of an apparatus of driving an agitator of an upright vacuum cleaner according to the present invention.
Figure 5:
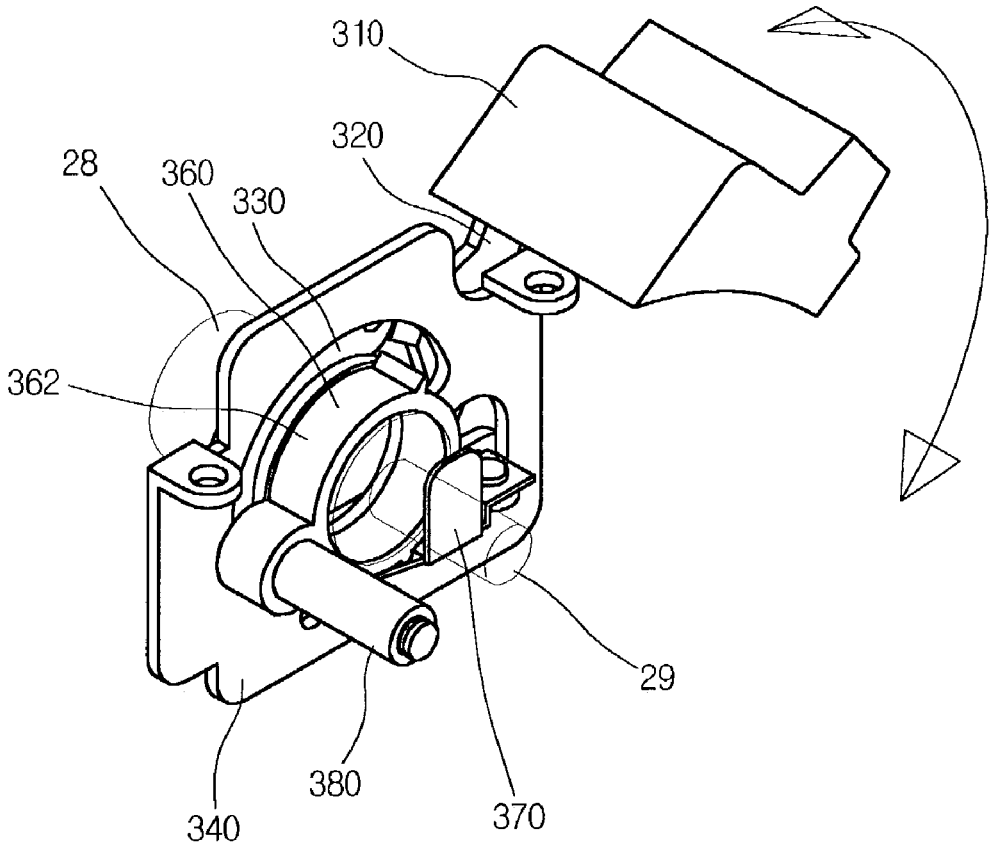
FIG. 5 is a front perspective view of an apparatus of driving an agitator of an upright vacuum cleaner according to the present invention.
Figure 6:
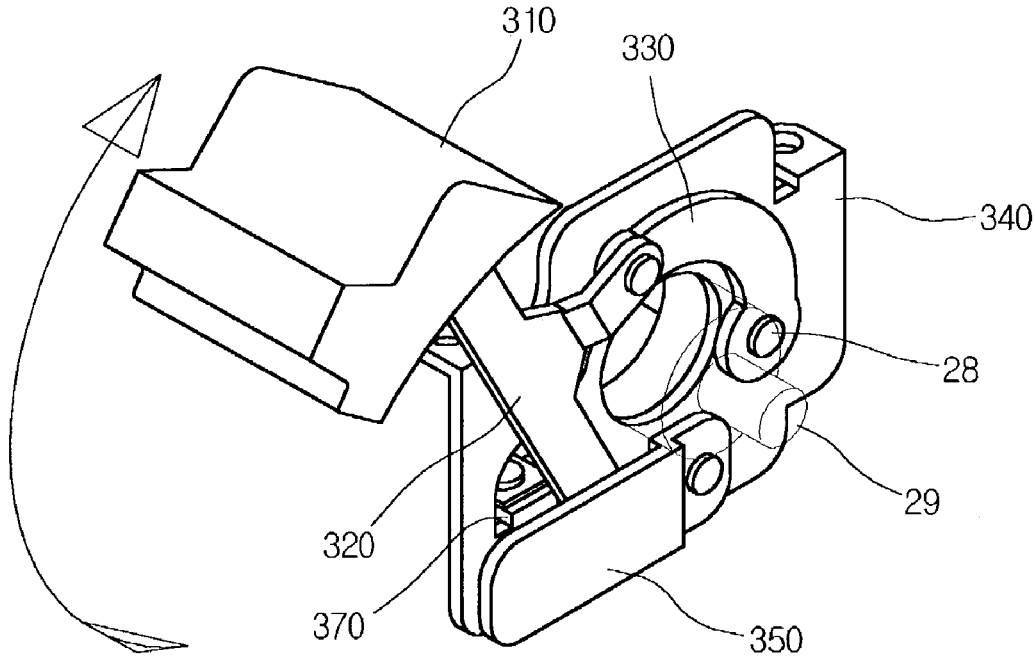
FIG. 6 is a rear perspective view of an apparatus of driving an agitator of an upright vacuum cleaner according to the present invention.

FIG. 3 is a magnified perspective view of an apparatus of driving an agitator of an upright vacuum cleaner according to the present invention. FIG. 5 is a front perspective view of an apparatus of driving an agitator of an upright vacuum cleaner according to the present invention. FIG. 6 is a rear perspective view of an apparatus of driving an agitator of an upright vacuum cleaner according to the present invention.

Referring to FIGS. 3, 5 and 6, the agitator driving apparatus includes a fixing panel 340 for fixing all elements of the agitator driving apparatus to a vacuum cleaner body, a handling part 310 to which an external force of a user is directly applied to control the power transmitted to an agitator 26, a selection lever 320 having one end connected to the handling part 310, for amplifying and transmitting an external force, a selection link 330 one end of which is hinge-coupled to a predetermined portion of the selection lever 320, for switching the transmission of the external force by a rotational reciprocating movement, a rotational driving part 360 hinge-coupled to the selection link 330, for controlling the power transmitted to the belt 27 by a self-rotation, a stopper guide 370 for stopping the rotational driving part 360 stably at a properly instructed location while the rotational driving part 360 rotates, an idle roller 380 inserted onto a predetermined shaft extended from the rotational driving part 360, for elastically supporting the belt 27 when the belt 27 is stopped, and a protection cover 350 for protecting the selection lever 320 from external disturbance.

The operation of the agitator driving apparatus will be described briefly.

External force is transmitted to the handling part 310 by a user. The external force transmitted to the handling part 310 is transmitted to the rotational driving part 360 through the selection lever 320 and selection link 330. The rotational driving part 360 self-rotates around the driving shaft roller 29. The idle roller 380 rotates along with the rotational driving part 360 due to the rotation of the rotational driving part 360, so that its contact location is changed. The belt 27 wound around the outer circumference of the idle roller 380 changes its contact state with the driving shaft roller 29 by the revolution of the idle roller 380. For example, referring to the front perspective view shown in FIG. 5, the connection of the driving shaft roller 29 and the belt 27 is released when the idle roller 380 moves clockwise. And, the driving shaft roller 29 is connected with the belt 27 again when the idle roller 380 moves counterclockwise.

Meanwhile, the stopper guide 370 allows the rotational driving part 360 that is rotating to be stably maintained at a constant position by locking or releasing a predetermined projection formed on the outer circumference of the rotational driving part 360.

Also, the protection cover 350 has one end fixed to the fixing panel 340. Another portion of the protection cover 350 that is not fixed to the fixing panel 340 but extended forms a predetermined gap from the fixing panel 340. The selection link 330 is placed within the gap between the fixing panel 340 and the protection cover 350 such that the selection lever 320 is protected from an external impact that can be applied but not predicted.

Figure 4:
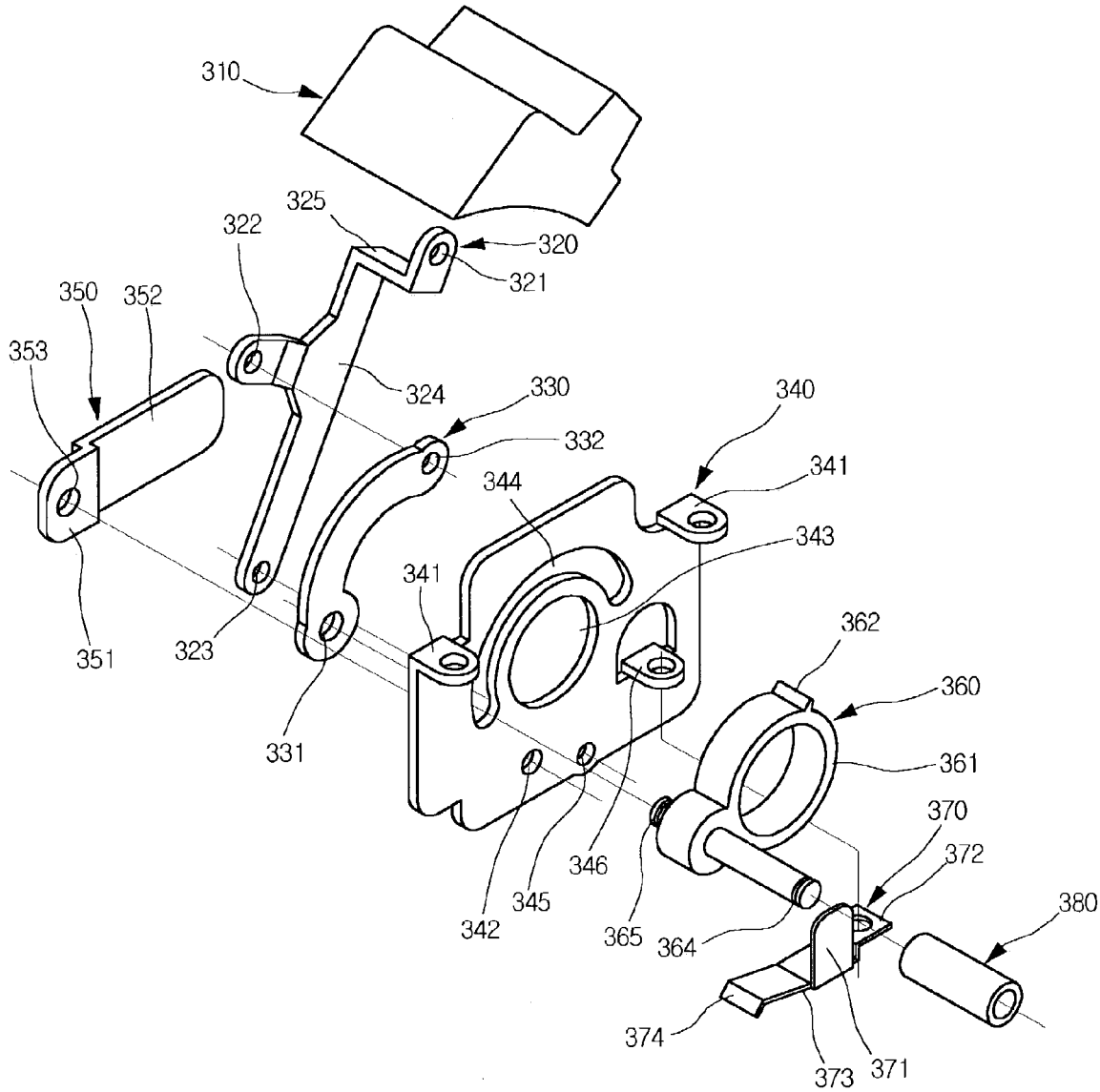
FIG. 4 is an exploded perspective view of an apparatus of driving an agitator of an upright vacuum cleaner according to the present invention.

FIG. 4 is an exploded perspective view of an apparatus of driving an agitator of an upright vacuum cleaner according to the present invention.

Referring to FIG. 4, the handling part 310, the selection lever 320, the selection link 330, the fixing panel 340, the protection cover 350, the rotational driving part 360, the stopper guide and the idle roller 380 are shown. Hereinafter, The detailed description will be made on shape and configuration of each part of the foregoing elements.

As a user steps on the handling part 310 or moves it up, the handling part 310 is subject to external force. In particular, if the user steps on the handling part 310, the belt (refer to 27 in FIG. 3) is wound around the outer circumference of the idle roller 380, so that power is not transmitted to the agitator (see 26 in FIG. 3). If the user moves the handling part 310 up by using his or her foot, the rotational driving part 360 rotates around the bushing (see 28 in FIG. 3) due to the elastic force of the belt 27 and the belt 27 is wound around the outer circumference of the driving shaft roller (see 29 in FIG. 3), so that power is transmitted to the agitator 26.

The selection lever 320 has one end fixed to the handling part 310 and is supplied external force from the handling part 310.

The detailed description will be made on the selection lever 320. The selection lever 320 includes a lever body 324, a first lever hole 321 fixed to the handling part 310, a first bent portion 325 which is bent vertically and has a predetermined length so as to be fixed and maintain a constant gap between the selection lever 320 and the handling part 310, a second lever hole 322 extending from almost center portion of the lever body 324 in a direction perpendicular to the lever body 324 fixed to the selection link 330, a third lever hole 323 formed at the other side of the first lever hole 321 and hinge-coupled to the fixing panel 340 as a central axis for the rotation of the selection lever 320.

The description will be made on the movement of the selection lever 320. The selection lever 320 is supplied external force from the user through the first lever hole 321 and the selection lever 320 and it can be rotated about the third lever hole 323 by the external force. Meanwhile, the rotational movement of the selection lever 320 causes the movement of the selection link 330 connected to the second lever hole 322.

The selection link 330 includes a second link hole 332 formed at one end thereof in the bent shape and connected to the second lever hole 322, and a first link hole 331 connected to the rotational driving part 360.

The operation of the selection link 330 will be described. The selection link 330 is supplied external force transmitted to the second lever hole 322 by the second link hole 330. The first link hole 331 transmits the external force to the rotational driving part 360 by the movement of the selection link 330.

The protection cover 350 includes a fixing surface 351 fixed to a side of the fixing panel 340, a guide surface bent and extending from the fixing surface 351, and a fixing hole 353 formed at the fixing surface 351 and fixed to the fixing panel 340.

The operation of the protection cover 350 will be described. The protection cover 350 guides a rotation movement of the selection lever 320 properly and protects the selection lever 320 from the external impact that can be applied to the selection lever 320.

The rotational driving part 360 includes a circular skirt shaped rotation guide 361 which is inserted into the bushing 28 and smoothly self-rotates, a hanging protrusion 362 formed on the outer circumference of the rotation guide 361 and projecting, a roller support part 364 extending in the insertion direction of the rotation guide 361 at a predetermined location of the outer circumference of the rotation guide 361, and a support or link connecting part 365 which extends in an opposite direction to the extending direction of the roller support part 364 and is inserted into the first link hole 331 and supported. The idle roller 380 is inserted onto the outer circumference of the roller supporting unit 364 to rotate freely. For this purpose, it is desirable that lubricant or lubricant means is provided in the contact surface of the roller support part 364 and the idle roller 380.

Next, an operation of the rotational driving part 360 will be described. In the whole operation of the rotational driving part 360, the rotational driving part 360 is supplied external force through the support or link connecting part 365 connected to the selection link 330 and changes the position of the idle roller 380 through the roller support part 364. The inner circumference of the rotation guide 361 is adapted to be facially contacted with the outer circumference of the bushing 28, so that the rotation guide 361 can self-rotate in an accurately coaxial state with the bushing 28. Also, the hanging protrusion 362 is adapted to perform a kind of locking operation, so that the position of the rotational driving part 360 can be indicated stably and accurately.

The stopper guide 370 is configured to lock the hanging protrusion 362 such that the exact location of the rotational driving part 360 is indicated. In detail, the stopper guide 370 includes a fixing portion 372 fixed to the fixing panel 340, an elastic bent portion 373 extending from the fixing portion 372 and to which an elastic force is applied, a hanging jaw 374 which is bent downwardly from an end of the elastic bent portion 373, and a guide 371 which is bent upwardly from a predetermined portion of the elastic bent portion 373, to prevent the rotational driving part 360 from being escaped from the bushing 28 and accurately guide the position and the moving direction of the rotational driving part 360.

Description will be made on the operation of the stopper guide 370. The stopper guide 370 serves to accurately guide the rotational movement of the rotational driving part 360. In other words, right before the rotation guide 361 rotates and the hanging protrusion 362 goes over the hanging jaw 374, the hanging jaw 374 moves downwards elastically due to the elastic force of the elastic bent portion 373. Once the hanging protrusion 362 has gone over the hanging jaw 374, the hanging protrusion 363 cannot return to the opposite direction and is secured by the hanging jaw 374. Even when the rotation guide 361 rotates in an opposite direction to move beyond the hanging jaw 374, the elastic bent portion 373 is moved with being transformed elastically.

The fixing panel 340 includes a guide hole 344 into which the support or link connecting part 365 is inserted and which is shaped in a circular arc to be a concentric circle with the rotation guide 361, for guiding the movement of the support or link connecting part 365, a panel fixing portion 341 for fixing the fixing panel 340 to the vacuum cleaner, a bushing insertion hole 343 into which the bushing 28 is inserted such that the fixing panel 340 is supported stably, a first panel hole 342 aligned with the fixing hole 353 of the protection cover 350 and adapted to fix the protection cover 350, a second panel hole 345 aligned with the third lever hole 323 of the selection lever 320 and formed in the fixing panel 340 to hinge-couple the selection lever 320, and a stopper guide fixing portion 346 aligned with the fixing portion 372 of the stopper guide 370, for fixing the stopper guide 370 by a predetermined coupling tool.

Referring to the construction of the foregoing elements, description is made on the operation of the apparatus of driving an agitator of an upright vacuum cleaner according to the present invention.

The panel fixing hole 341 is aligned with a predetermined boss or a protrusion extending from the body of the vacuum cleaner. A coupling tool such as a screw is inserted into the panel fixing hole 341 such that the fixing panel 340 is fixed. The second panel hole 345 is hinge-coupled to one end of the selection lever 320 and the selection lever 320 rotates about the second panel hole 345. The protection cover 350 is coupled with and fixed to the first panel hole 342. The bushing 28 is inserted into the bushing insertion hole 343 such that the fixing panel 340, especially, as a rotation center is fixed firmly to the body of the vacuum cleaner. The support or link connecting part 365 is inserted into the guide hole 344 so as to guide the rotational movement of the rotational driving part 360. The stopper guide fixing portion 346 is aligned with the fixing portion 372 formed in the stopper guide 370 and guides the exact position of the stopper guide 370 such that the stopper guide 370 is maintained firmly at an indication position.

FIG. 5 is a front perspective view of an apparatus of driving an agitator of an upright vacuum cleaner according to the present invention. FIG. 6 is a rear perspective view of an apparatus of driving an agitator of an upright vacuum cleaner according to the present invention.

Referring to FIGS. 5 and 6, owing to the user's he rotational driving part 360 is rotated with respect to the busing 28 due to the user's external force applied to the handling part 310. The handling part rotates in the direction of the arrows shown in FIGS. 5 and 6.

In more detail, the external force applied by the user's foot rotates the handling part 310. The selection lever 330 is pulled or pushed by the rotational movement of the handling part 310. The movement of the selection lever 320 is transformed into the rotational movement of the selection link 330 and is then transmitted. The rotational movement of the selection link 330 serves as a torque to rotate the rotational driving part 360 to allow the rotational driving part 360 to rotate about the bushing 28. The rotation of the rotational driving part 360 allows the idle roller 380 to move around the bushing 28 so that the belt wound around the outer circumference of the idle roller 380 is wound or not wound around the outer circumference of the driving shaft roller 29. In other words, the belt 27 is selectively coupled with the driving shaft roller 29.

In detail, when the handling part 310 rotates counterclockwise referring to the front perspective view of FIG. 5, the belt 27 is wound around the driving shaft roller 29 such that the power is transmitted from the driving shaft roller 29 to the belt 27 and the agitator 26. However, when the handling part 310 rotates clockwise referring to the front perspective view of FIG. 5, the belt 27 is wound around the idle roller 380 but not wound around the driving shaft roller 29 such that the power is not transmitted from the driving shaft roller 29 to the belt 27 and the agitator 26.

In the meanwhile, when the handling part 310 rotates clockwise, the hanging protrusion 362 formed on the outer circumference of the rotation guide 361 is locked on the hanging jaw 374 such that the rotation guide 361 is stopped accurately. At this time, it is required that the tension of the belt 27 and the strength by which the hanging protrusion 362 goes over the hanging jaw 374 be applied to the handling part 310.

Also, when the handling part 310 rotates counterclockwise, it is required that the external force be applied to the handling part 310 such that the hanging protrusion 362 is pushed to escape from the hanging jaw 374. At this time, if the hanging protrusion 362 escapes from the hanging jaw 374, the rotation guide 36 is rotated counterclockwise owing to the tension of the belt 27.

Similarly, for the agitator driving apparatus to well operate by the tension of the belt 27, the agitator 26, the driving shaft 29 and the idle roller 380 can be aligned in a line in a state that the handling part 310 is completely rotated clockwise or counterclockwise. Further, the guide hole 344 can form a circular arc of 180 degree.

In other words, in case the handling part 310 rotates counterclockwise, after a predetermined force is applied such that the hanging protrusion 362 can go over the hanging jaw 374, the balance of the force is broken and the rotation guide 361 can continue to rotate counterclockwise because of the tension of the belt 27.

Figure 7:
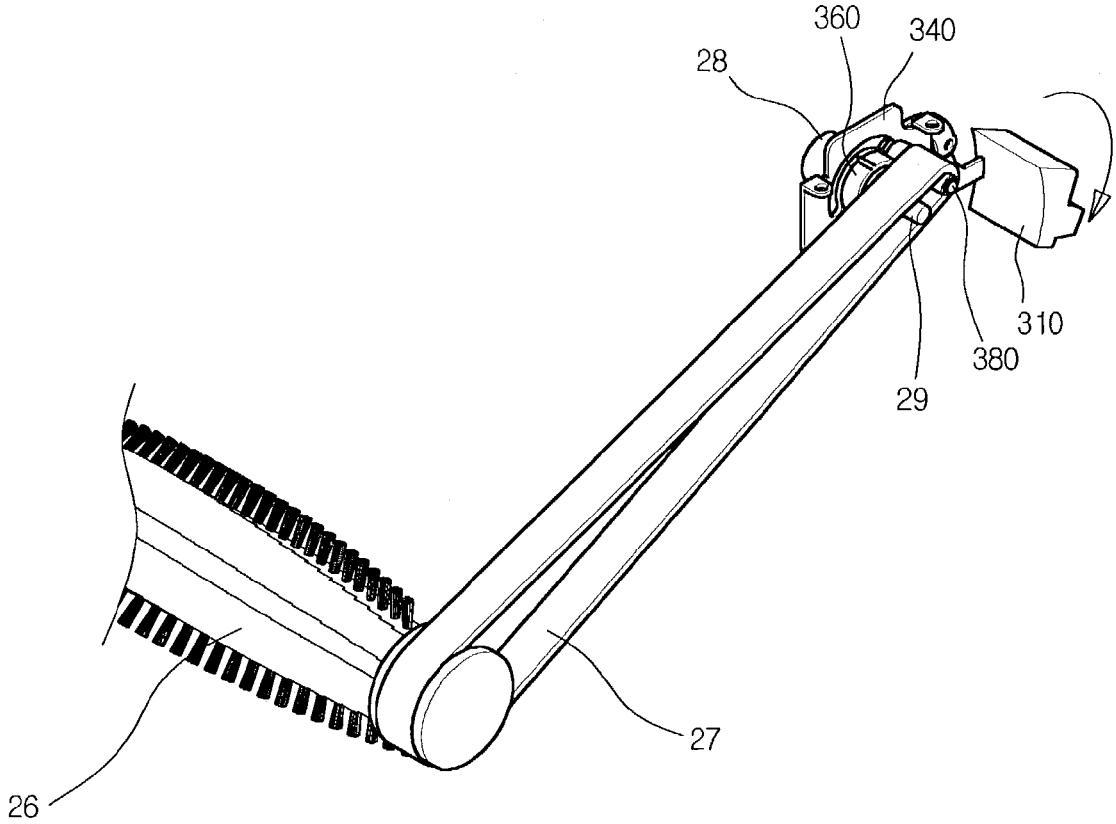
FIG. 7 is a front perspective view illustrating that power is not transmitted to an agitator in an apparatus of driving an agitator of an upright vacuum cleaner according to the present invention.

FIG. 7 is a front perspective view illustrating that power is not transmitted to an agitator in an apparatus of driving an agitator of an upright vacuum cleaner according to the present invention.

Referring to FIG. 7, the handling part 310 rotates clockwise (in the arrow direction). The rotation guide 361 also rotates about the bushing 28 clockwise. The hanging protrusion 362 is locked on the hanging jaw 374 such that the rotation guide 361 cannot rotate counterclockwise again despite the tension of the belt 27. Since the support or link connecting part 365 moves with being guided according to the shape of the guide hole 344, the rotation guide 362 can rotate to a right position in a desired direction. In this case, the belt 27 is wound around the outer circumference of the idle roller 29 but not contacted with the driving shaft roller 29. Accordingly, the power of the driving shaft roller 29 is not transmitted to the belt 27 and the agitator 26 does not rotate too. Hence, when cleaning a bare floor, the agitator does not rotate and does not make any scratch on the floor.

Figure 8:
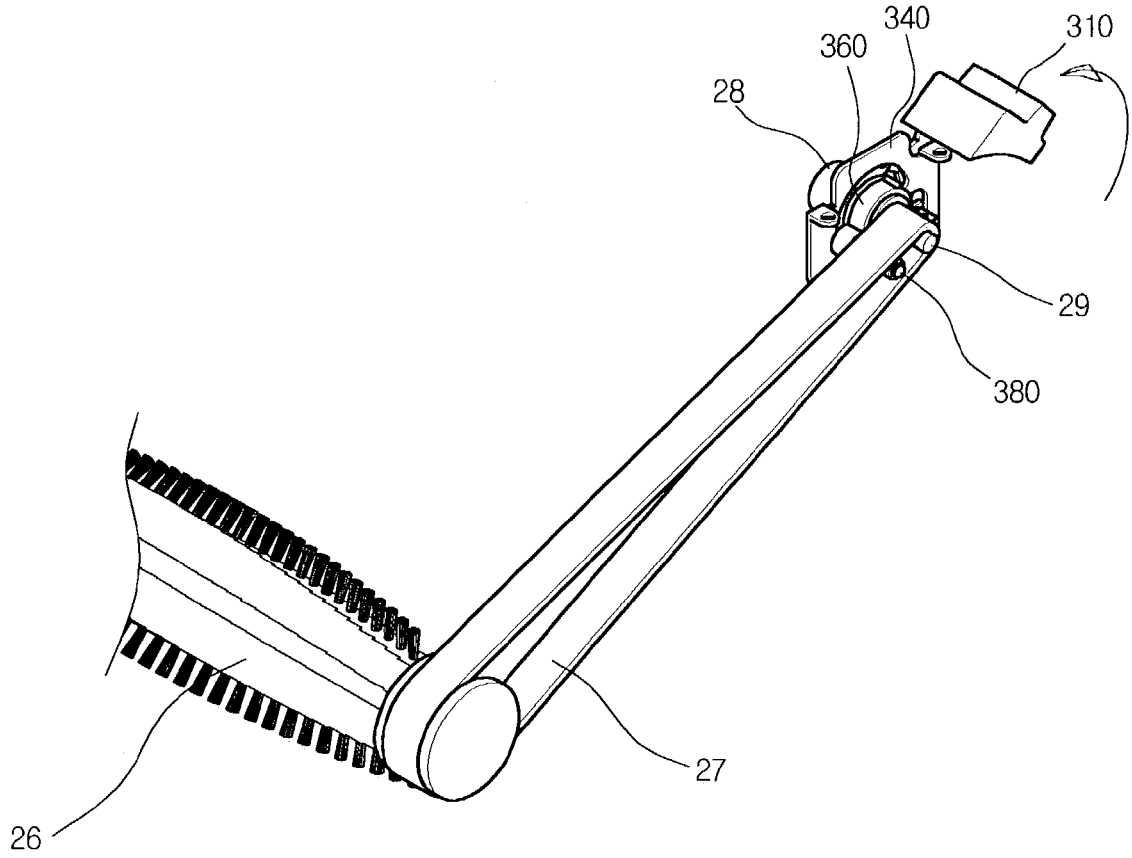
FIG. 8 is a front perspective view illustrating that power is transmitted to an agitator in an apparatus of driving an agitator of an upright vacuum cleaner according to the present invention.

FIG. 8 is a front perspective view illustrating that power is transmitted to an agitator in an apparatus of driving an agitator of an upright vacuum cleaner according to the present invention.

Referring to FIG. 8, the handling part 310 has been rotated counterclockwise (in the arrow direction) and the rotation guide 361 has been rotated counterclockwise about the bushing 28. Meanwhile, since the support or link connecting part 365 moves with being guided according to the shape of the guide hole 344, the rotation guide 362 can rotate to a right position in a desired direction. When the rotation guide 362 moves from the state shown in FIG. 7 to the state shown in FIG. 8, the idle roller 380 is pulled due to the tension of the belt 27. Hence, the user is required to apply a small amount of force to the handling part 310 for initial operation. For this operation, the belt 27 can be made of elastic material.

Similarly, while the power is transmitted, the belt 27 is not wound around the outer circumference of the idle roller 380 but wound around the driving shaft roller 29. So, the power is transmitted to the belt 27 completely and the idle roller 380 does not participate in the power transmission.

As a result, the agitator 26 can rotate and a carpet and a floor with much dust can be cleaned.

Figure 9:
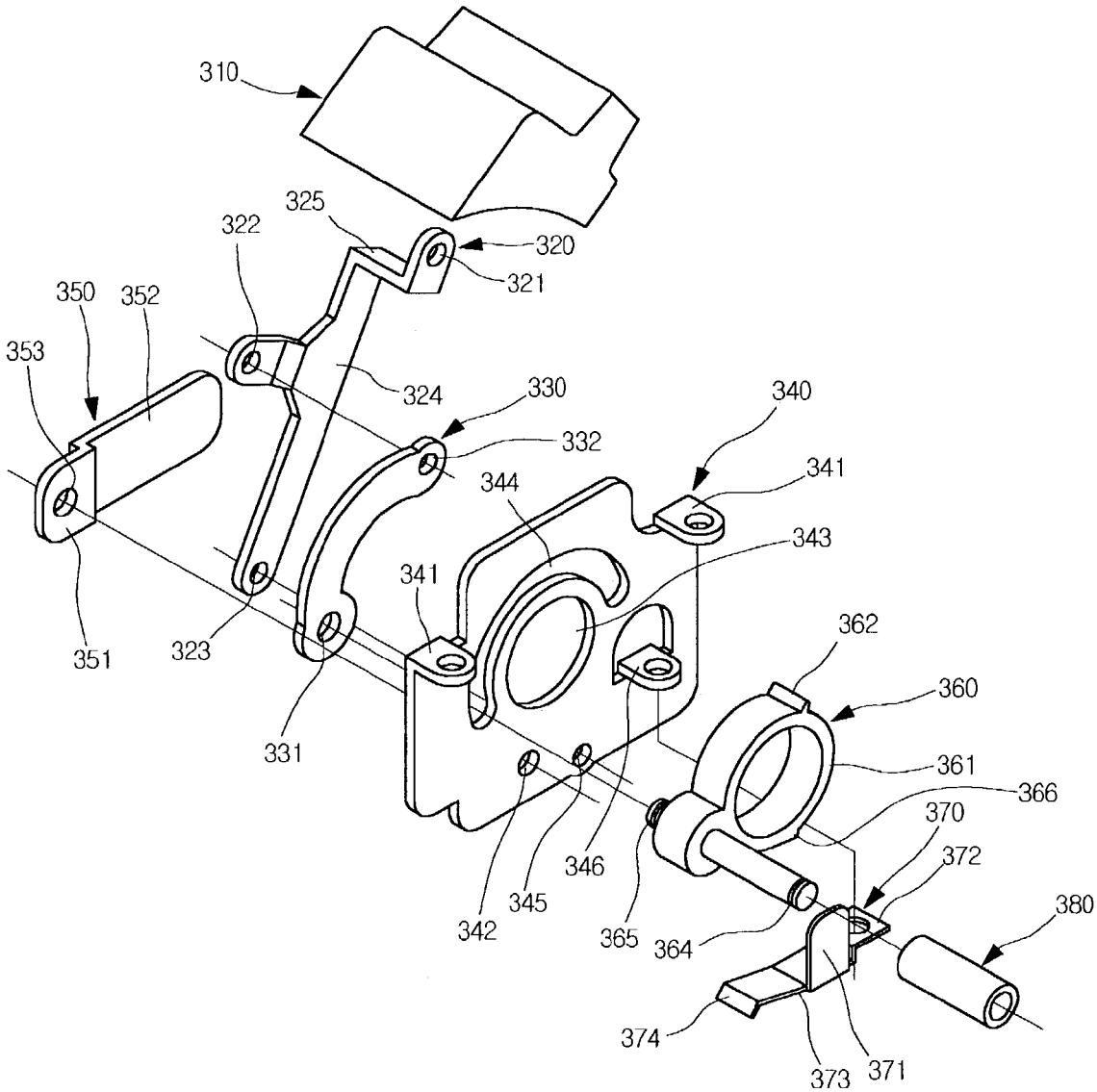
FIG. 9 is an exploded perspective view of an apparatus of driving an agitator of an upright vacuum cleaner according to another embodiment of the present invention.

FIG. 9 is an exploded perspective view of an apparatus of driving an agitator of an upright vacuum cleaner according to another embodiment of the present invention.

The agitator driving apparatus shown in FIG. 9 has a similar configuration to the agitator driving apparatus of the previously described embodiment except that a mounting portion 366 is formed such that the rotational driving part 360 is not moved when the rotational driving part 360 is rotated in a direction that power is not transmitted to the agitator.

In other words, when the rotational driving part 360 is rotated counterclockwise, the mounting portion 366 is mounted in a wide area so as to be locked by the stopper guide 370, thereby preventing the rotational driving part 360 from being moved to a non-intended direction without any external force.

For this purpose, when the rotational driving part 360 is rotated clockwise, a contact surface of the rotational driving part 360 with the stopper guide 370 is formed in a horizontal direction (i.e., tangential direction), and an opposite direction portion from the uppermost position of the mounting portion 366 is formed protrudedly like the hanging protrusion 362.

Figure 10:
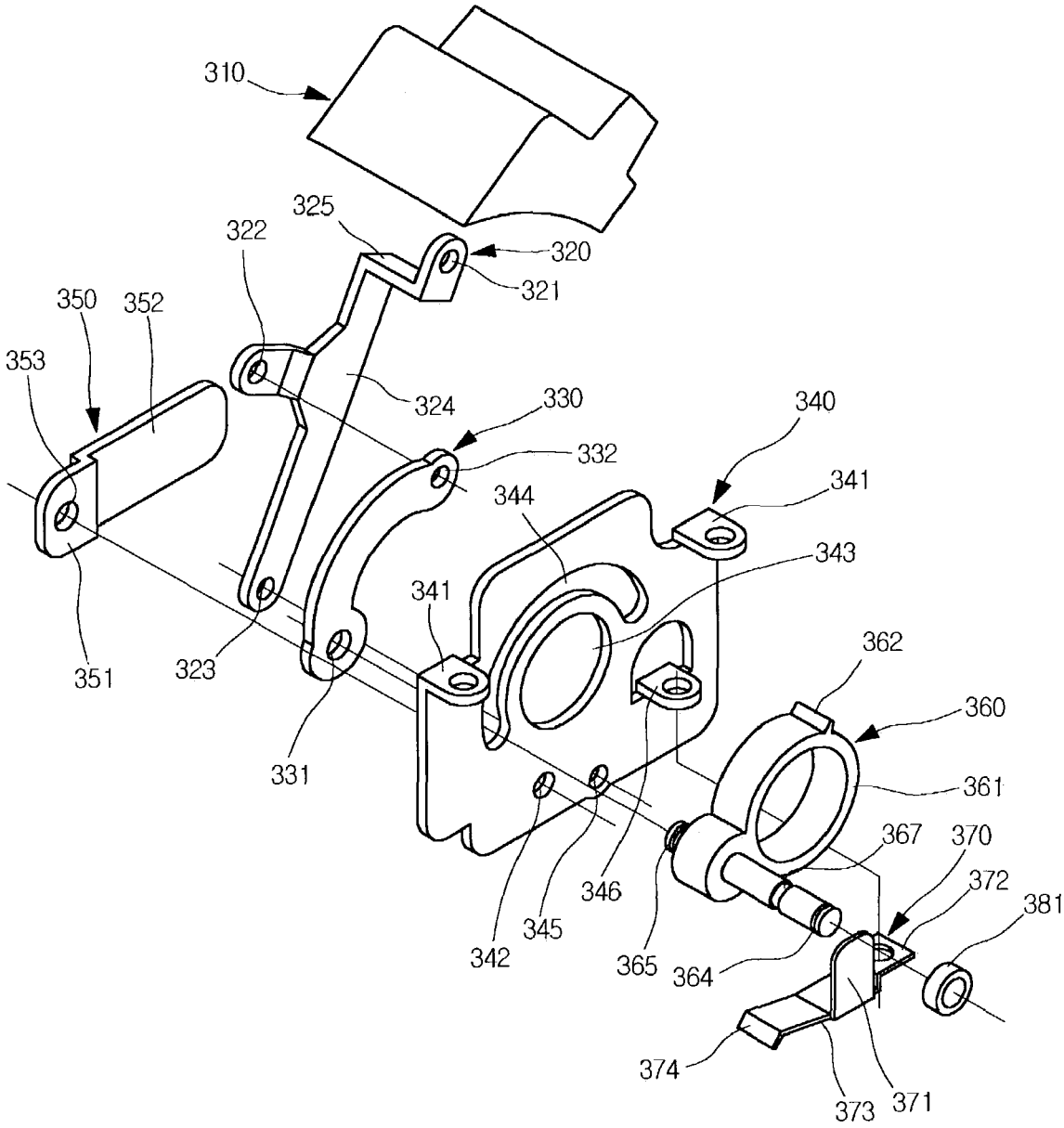
FIG. 10 is an exploded perspective view of an apparatus of driving an agitator of an upright vacuum cleaner according to a further embodiment of the present invention.

FIG. 10 is an exploded perspective view of an apparatus of driving an agitator of an upright vacuum cleaner according to a further embodiment of the present invention.

The agitator driving apparatus shown in FIG. 10 has a similar configuration to the agitator driving apparatus of the previously described embodiment except for a portion where the idle roller 380 is installed.

In more detail, an insertion groove 367 is formed at a predetermined location of the outer circumference of the roller support part 364, and a bearing 381 is arranged on a predetermined portion of the outer circumference of the roller support part 364 at least including the insertion groove 367. Belt 27 is wound on the outer circumference of the bearing 381. By doing so, the bearing 381 serving as the idle roller is formed not on the entire surface of the roller support part 364 but on a part of the roller support part 364, so that the belt 27 is stably rotatable without any hindrance with respect to other elements. Also, since the sliding structure can be formed in a small size, it is possible to manufacture the agitator driving apparatus at a low price.

The apparatus of driving an agitator of an upright vacuum cleaner according to the present invention allow the user to control the agitator conveniently using his or her foot.

Since the apparatus of driving an agitator of an upright vacuum cleaner according to the present invention requires only a single motor inside, the entire structure of the vacuum cleaner is simplified and the vacuum cleaner can be configured by simply combining components.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An apparatus for driving an agitator of an upright vacuum cleaner, the apparatus comprising:

a motor for driving a suction fan of the vacuum cleaner;

a driving shaft roller installed at an end of the motor, around which a power transmission member is wound intermittently;

a bushing mounted on an outer circumference of the driving shaft roller;

a fixing panel fixed to the vacuum cleaner;

a rotational driving part which the bushing is inserted at a center thereof, the rotational driving part rotating around the driving shaft roller;

a selection lever rotating around a lever hole hinge-coupled to the fixing panel by an applied external force;

a selection link one end of which is hinge-coupled to the body of the selection lever;

a link connecting part extending in a direction of an axis parallel with the driving shaft roller on an outer circumference of the rotational driving part and coupled with the other end of the selection link;

a roller support part extending in an opposite direction from an extension of the link connecting part;

an idle roller on an outer circumference of the roller support part and around which the power transmission member is wound intermittently due to rotation of the entire rotational driving part so that power is controlled to be transmitted; and a stop means for maintaining a position determined by a self-rotation of the rotational driving part.

2. The apparatus according to claim 1, wherein the power transmission member is a belt comprising elastic material.

3. The apparatus according to claim 1, wherein the stop means comprises:

a hanging protrusion formed on a predetermined position of the outer circumference of the rotational driving part; and a stopper guide comprising elastic material and extending from the fixing panel such that the hanging protrusion is locked.

4. The apparatus according to claim 1, wherein the fixing panel comprises an insertion hole into which the link connecting part is inserted to guide positional movement of the linking connecting part.

5. The apparatus according to claim 4, wherein the insertion hole is shaped in a circular arc having a predetermined width.

6. The apparatus according to claim 1, further comprising a protection cover fixed on the fixing panel, for covering a separated outer side of the selection lever so as to protect the selection lever.

7. The apparatus according to claim 1, wherein the stop means comprises:

a hanging protrusion formed on the outer circumference of the rotational driving part;

a hanging jaw on which the hanging protrusion is locked; and an elastic bent portion extending from the hanging jaw, for allowing the hanging jaw to behave elastically.

8. The apparatus according to claim 7, further comprising a guide portion bent at one side surface of the elastic bent portion, for guiding a rotational operation of the rotational driving part.

9. The apparatus according to claim 1, wherein the selection link is curved.

10. The apparatus according to claim 1, further comprising a handling part fixed to one end of the selection lever, the handling part being configured to receive an external force.

11. An apparatus of driving an agitator of an upright vacuum cleaner, the apparatus comprising:

a driving shaft roller installed at an end of a motor of the vacuum cleaner, around which a power transmission member is wound intermittently;

a bushing installed on an outer circumference of the driving shaft roller coaxially with a driving shaft;

a fixing panel inserted onto the bushing;

a selection lever rotating about a lever hole hinge-coupled to the fixing panel by an applied external force;

a selection link whose one end is hinge-coupled to the body of the selection lever;

a rotational driving part including a rotation guide shaped in a circular skirt and into which a bushing is inserted and rotated, a link connecting part extending in a direction of an axis parallel with the driving shaft roller on an outer circumference of the rotation guide and coupled with one end of the selection link, and a roller support part extending in an opposite direction to the extension of the link connecting part;

an idle roller disposed on an outer circumference of the roller support part and around which the power transmission member is wound intermittently due to a self-rotation of the entire rotational driving part such that a power transmission is controlled; and a stop means for maintaining a position determined by the self-rotation of the rotational driving part.

12. The apparatus according to claim 11, wherein the power transmission member is a belt elastic material.

13. The apparatus according to claim 11, wherein the stop means comprises:

a hanging protrusion formed on a predetermined position of the outer circumference of the rotational driving part; and a stopper guide comprising elastic material and extending from the fixing panel such that the hanging protrusion is intermittently locked.

14. The apparatus according to claim 11, wherein the fixing panel comprises an insertion hole shaped in a circular arc and into which the link connecting part is inserted.

15. The apparatus according to claim 11, further comprising a protection cover for protecting the selection lever externally.

16. The apparatus according to claim 11, wherein the stop means comprises:

a hanging protrusion formed on the outer circumference of the rotation guide; and a stopper guide essentially including a hanging jaw which is bent to lock the hanging protrusion, and an elastic bent portion extending from the hanging jaw.

17. The apparatus according to claim 11, further comprising a handling part fixed to one end of the selection lever.

18. An apparatus of driving an agitator of an upright vacuum cleaner, the apparatus comprising:

a driving shaft roller connected to a motor for driving a suction fan of the vacuum cleaner and around which an elastic member is selectively wound;

a bushing installed on an outer circumference of the driving shaft roller;

a fixing panel being penetrated by the bushing;

a rotational driving part revolving around the bushing; a link connecting part and a roller support part which are formed in a direction of an axis parallel with the driving shaft roller on an outer circumference of the rotational driving part;

a manipulating means connected with the link connecting part, for manipulating the rotational driving part;

an idle roller inserted into the roller support part and around which an elastic member is wound; and a stop means for maintaining a position of the rotational driving part stably.

19. An apparatus of driving an agitator of an upright vacuum cleaner, the apparatus comprising:

a driving shaft roller extending from the vacuum cleaner;

a fixing panel and a rotation guide which are positioned outside the driving shaft roller and rotates coaxially with the driving shaft roller;

a link connecting part and a roller support part which are formed in a direction of an axis parallel with the driving shaft roller on an outer circumference of the rotation guide;

an idle roller inserted into the roller support part;

a manipulating means connected with the link connecting part, for manipulating the rotation guide so that the elastic member is selectively wound around the driving shaft roller or the idle roller; and a stop means for maintaining a position of the rotational driving part stably.

20. The apparatus according to claim 19, wherein the roller support part comprises an insertion groove formed on an outer circumference thereof such that the idle roller is mounted.

21. The apparatus according to claim 19, wherein the idle roller is a bearing, formed only on a partial outer circumference of the roller support part.

22. The apparatus according to claim 19, wherein the rotation guide comprises a mounting portion formed on a predetermined portion of an outer circumference of the rotation guide, for supporting the location of the rotation guide when the elastic member is wound on the driving shaft roller.

23. The apparatus according to claim 22, wherein the mounting portion comprises a portion formed in a tangential direction and a protruding portion.

24. An apparatus for driving an agitator of an upright vacuum cleaner, the apparatus comprising:

a driving shaft roller;

a rotational driving part revolving around the driving shaft roller, the rotational driving part including a rotation guide;

a fixing panel fixed to the vacuum cleaner;

a roller support part positioned on an outer periphery of the rotation guide;

a bushing between the driving shaft roller and the rotation guide;

a link connecting part on a side of the fixing panel, said link connecting part being coaxial with the roller support part; and a manipulating device on the side of the fixing panel, the manipulating device being connected with the link connecting part and being configured to manipulate the rotation guide.

* * * * *